United States Patent [19]

Dixon et al.

[11] Patent Number: 4,976,480

[45] Date of Patent: Dec. 11, 1990

[54] CYLINDRICAL LOCKSET HAVING QUICK MOUNT MEANS ACCOMMODATING VARIOUS THICKNESS OF DOORS

[75] Inventors: David Dixon, Monroe, N.C.; Walter E. Surko, Jr., Southington, Conn.

[73] Assignee: Yale Security Inc., Monroe, N.C.

[21] Appl. No.: 505,188

[22] Filed: Apr. 5, 1990

[51] Int. Cl.[5] ..... E05B 3/00

[52] U.S. Cl. ..... 292/353; 292/357

[58] Field of Search ..... 292/353, 357, 347, 354, 292/DIG. 60, DIG. 53, 336.3, 169 R

[56] References Cited

U.S. PATENT DOCUMENTS

| | | | |
|---|---|---|---|
| 860,171 | 7/1907 | Welch et al. | 292/353 |
| 2,929,649 | 3/1960 | Coe | 292/357 X |
| 4,588,221 | 5/1986 | Miller et al. | 292/353 X |
| 4,679,420 | 7/1987 | Yang | 292/353 X |

*Primary Examiner*—Richard E. Moore

*Attorney, Agent, or Firm*—Dallett Hoopes

[57] ABSTRACT

This lockset has a threaded inside sleeve extending out from its central housing, the sleeve enclosing the inside spindle for the lockset. An inside rose and handle assembly is provided, the rose having inward tabs. A nut is threaded onto the sleeve and has spaced openings about its end remote from the housing, the openings each leading to a series of steps in clockwise direction progressively closer to the housing. Each step has a tread and a riser so that when the handle is brought over the spindle and the rose is maneuvered so that the tabs fit into the openings and the rose is turned in a clockwise direction, the tabs will engage the closest riser to the housing that the thickness of the door will permit. Further clockwise turning of the rose will turn the nut and move the nut closer to the housing so that the treads engage the tabs and draw the rose/handle assembly inward to firmly and quickly install the lockset on the door.

9 Claims, 1 Drawing Sheet

CYLINDRICAL LOCKSET HAVING QUICK MOUNT MEANS ACCOMMODATING VARIOUS THICKNESS OF DOORScl BACKGROUND OF THE INVENTION

1. Field of the Invention

This invention relates to a kind of lockset often referred to in the trade as a "cylindrical" lockset. The lockset of the invention is provided with simple means for quick attachment to doors of different thicknesses. More specifically, this invention relates to a lockset in which the inside handle and rose assembly has means attaching it firmly and quickly to an inside threaded sleeve or shank integral with its housing.

2. Description of Related Art including Information Disclosed under §§1.97 to 1.99

A "cylindrical" lockset generally comprises a housing which, despite the name, may or may not be cylindrical, the housing having sleeves extending centrally outward from either side. In the housing, which is adapted to be disposed in an opening through the door, is a retractor assembly which has a pair of inward fingers accessible through an opening in the periphery of the housing. The fingers engage a tailpiece on the latch mechanism which is operatively disposed in the end of the door. On the outside of the door a handle and rose assembly has an inward spindle which fits into and activates the retractor. The rose assembly is threaded on the outside sleeve of the housing and held from rotation by engagement with the door.

On the inside of the door the sleeve encloses a splined spindle which at its end remote from the housing has a pushbutton to effect the locking of the outside handle. The inside spindle and pushbutton are generally of fixed length. The inside handle has a rose liner provided with openings to receive bolts which extend into the housing. The liner in assembly is bolted to the housing. Subsequently, a rose scalp is brought over the sleeve and affixed to the liner and, finally, the knob is snapped into its place over the spindle to rotate therewith. Alternatively, the inside rose may be an assembly which is threaded onto the inside sleeve to pull the rose tightly against the door. The handle is then assembled over the spindle.

Examples of "cylindrical" locksets are shown in the following patents: U.S. Pat. No. 2,800,351 which issued July 23, 1957 to R. W. Schmid; U.S. Pat. No. 2,751,243 which issued June 19, 1956 to D. L. Biblin.

The mounting of the cylindrical lockset has involved the steps of adjusting the position of the outside handle and rose assembly on the outer sleeve according to the thickness of the door. The button end of the lockset is then extended through the door opening. The inside rose liner is then threaded onto the inside sleeve or is bolted onto the cylindrical housing, as described. The rose scalp is affixed to the rose plate or liner and the knob is snapped into place. If the door is thicker or thinner it will mean less or more threading or bolting of the inside rose plate onto its sleeve.

It can readily be seen that this installation involves manipulation of many parts and takes considerable time.

The present invention provides a cylindrical lockset having fewer parts to assemble coupled with quick installation means to accommodate doors of different thicknesses. At the same time the invention maintains one of the primary advantages of a cylindrical lockset: concealed attachment.

SUMMARY OF THE INVENTION

The cylindrical lockset of the present invention is provided on the inside of the door with a threaded sleeve secured to the housing. The sleeve carries a nut which is formed on its outer surface with a series of steps facing the housing and having treads which are disposed progressively closer to the housing as one proceeds in a clockwise fashion about the sleeve. Unlike the multiple part inside rose and handle arrangements of cylindrical locksets of the prior art, the present invention has an inside knob and rose assembly wherein the knob is provided with a shank to which the rose is rotatably secured. Inside the shank there is a key. The rose is provided in its liner with inward tabs.

The knob/rose assembly is brought over the inside spindle so that the key slides along the spline in the spindle. The tabs ultimately move into the openings in the periphery of the nut and the rose is pressed firmly against the door and turned in a clockwise fashion. The tabs engage the "riser" of the step inward of the nut to the extent that the width of the door will permit. The rose is then turned with a spanner wrench or other tool and once the tabs firmly engage the proximate riser, the continued turning of the rose moves the nut along the sleeve, the adjacent tread engaging under the tab to draw the rose firmly against the inside of the door to complete the installation.

BRIEF DESCRIPTION OF THE DRAWINGS

Other objects and features of the invention will be apparent from the following specification and drawings, all of which disclose a non/limiting form of the invention.

FIG. 3 is a split view: the portion of the view above the center line showing the lockset installed on a relatively thin door, and the portion of the lockset below the center line showing the lockset installed relatively thick door;

DESCRIPTION OF THE PREFERRED EMBODIMENT

Figure 1:
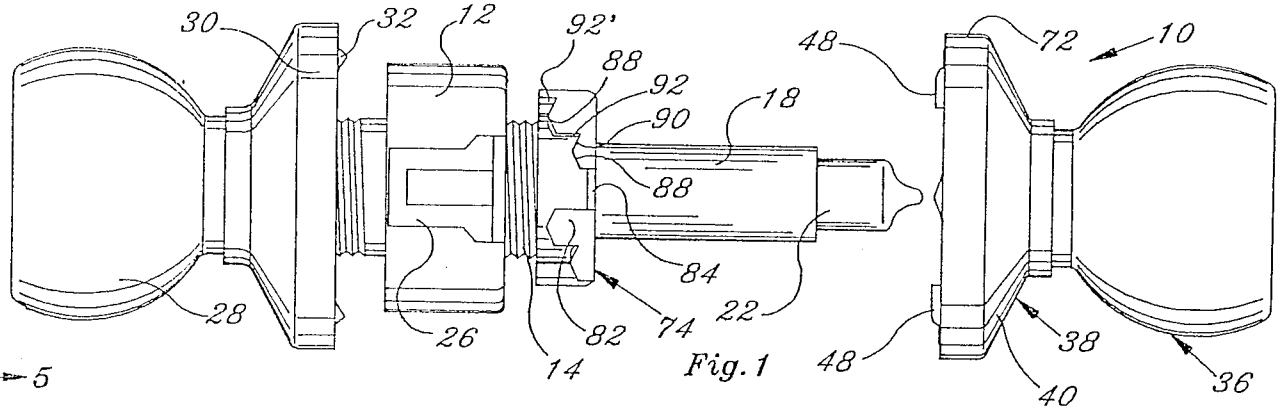
FIG. 1 is an exploded side elevational view of a lockset embodying the invention.

A lockset embodying the invention is generally designated 10 in FIG. 1. It comprises a cylindrical housing 12 adapted to be installed in an opening in the door and having a threaded inside sleeve 14 and a threaded outside sleeve 16 secured to the opposite sides thereof. An inside spindle 18 extends through the inside sleeve 14 and is splined as at 20 for reasons which will become apparent.

A pushbutton 22 is disposed at the end of the spindle 18 and may be pressed in to disable the unlatching mechanism within housing 12 as is well known in the art. An outside spindle 24 extends outward from the sleeve 16. Both the spindles 20 and 24 are structured to pull in the latch retractor 26 inside the housing 12 in a manner well known in the art.

An outside knob 28 is adapted to be snapped onto a spindle 24 so that it may turn therewith to operate the retractor 26. An annular rose 30 surrounds the neck of the handle 28 and is provided with a liner (not shown) which has inward nibs 32 which dig into the wood of the door to keep the rose 30 from turning.

The rose 30 is threaded onto the sleeve 16, and the knob 28 is mounted on the spindle 24. As is customary, consequently, when the knob 28 is turned, the spindle 24 will activate the latch retractor mechanism 26 to retract the latch (not shown).

Turning now to the site of the invention, the inside handle and rose assembly comprises the knob 36 and the rose 38, the latter being a scalp 40 and a liner 42. The liner is an annular element which has an outside wall 44 which is welded, or otherwise secured, to the outermost flange of the scalp 40. Adjacent the outermost flange 44 the liner is formed with an inward web 46 (FIG. 2) to which is secured radially inward projecting tabs 48. At its inward edge the web 46 is shaped axially as at 50 and then bends inward to form a final inward flange 52.

Figure 2:
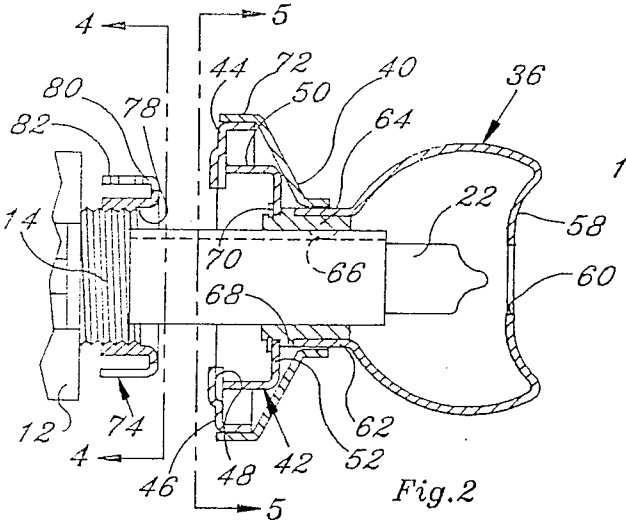
FIG. 2 is a sectional view of the inside handle and rose assembly about to be installed against the door.

As shown in FIG. 2, the knob 36 is formed with a recessed face 58 which is provided with a central opening 60. The opening receives a pushbutton or turnbutton 22.

As shown in FIG. 2, the knob 36 is formed with a neck 62 to which is secured a shank 64. The shank is formed with an inward key 66. A shoulder 68 (FIG. 2) is formed in the shank, and the inward flange 52 of the liner is received in rotatable fashion around the shank 64 against the shoulder 68. A snap ring 70 fits in a peripheral groove in the shank as shown to hold the flange on.

The outward peripheral flange of the rose scalp 40 is formed with a pair of small circular recesses 72 (FIG. 2) for engagement by a spanner wrench in tightening up the handle and rose assembly on the lockset.

Figure 3:
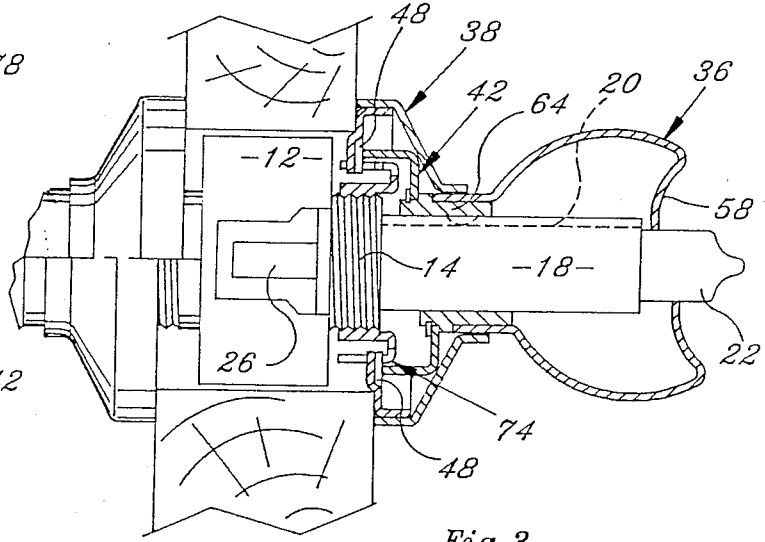
FIG. 3 a sectional view similar to FIG. 2 and showing the inside handle and rose installed against the door.
Figure 4:
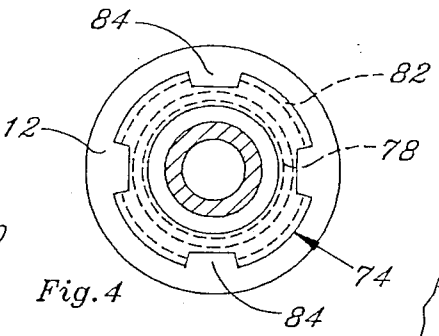
FIG. 4 is a sectional view taken on the line 4—4 of FIG. 2.
Figure 5:
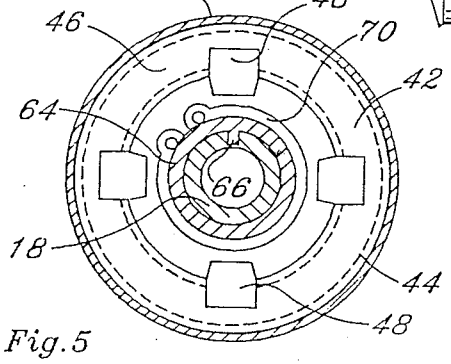
FIG. 5 is a sectional view taken on the line 5—5 of FIG. 2.

Threaded on to the threaded sleeve 14 is the nut 74. The nut as shown in FIGS. 2 and 3 is provided with a threaded central opening 78. The nut is U-shape in cross section (FIG. 2) with the bight web 80 of the nut disposed remote from the cylindrical housing 12.

The bight web 80 and the outer annular web 82 are designed to accommodate the tabs 48 on the inside rose 38. More specifically, aligned with each of the tabs 48 is an opening 84 in the bight web of the nut. The outer web 82 is formed adjacent the opening with a series of steps 88 moving in a clockwise direction from the opening 84. The steps 88 each comprise a tread 90 and a riser 92.

How the handle and knob assembly may be rapidly installed on the door is readily apparent from the drawings. The rose 30 is threaded on sleeve 16, in or out, to center the cylindrical housing in the door thickness. The nibs 32 engage into specially formed notches in the opening of the metal door or may be permitted to dig into the woodwork as the inside handle 36 and rose 38 is tightened.

It will be understood that the opening in the door for the lockset is able to accommodate the shape of the cylindrical lockset housing 12 and at that time that the housing is inserted in the opening in the door, the tailpiece on the latch engages the retractor 26 in the usual way.

In installing the inside handle, the rose and handle 36 are telescoped over the spindle 18, with the key 66 (FIG. 2) riding in the spline 20 along the side of the spindle. The tabs 48 are maneuvered into the openings 84 in the nut 74, and the inside rose 38 actually engages the door.

Figure 6:
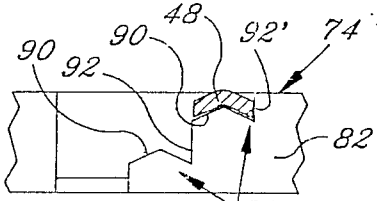
FIG. 6 an enlarged fragmentary view of the periphery of the nut showing its cooperation with a liner tab.

At this point the rose may be turned by hand so that the tabs engage the riser 92 or 92' of the step 88 closest to the proximate side of the nut which the thickness of the door will permit. If the door is a thick door, the tabs 48 will reach only to the riser 92 of the first step 88 whereas if the door is slender, the tabs 48 will reach the riser 92' of the next step (FIGS. 1 and 6).

The engagement of the tabs with the risers is brought about by the rotation of the rose in a clockwise fashion. Once the tab has met up with its accessible riser, further rotation of the rose will cause the nut 74 to rotate clockwise on the sleeve 14 drawing the nut inward so that the tabs are engaged by the adjacent treads 90 and the rose may be brought up snugly against the inside of the door. The detents or humps in the treads 90 will resist inadvertent counter-clockwise turning of the liner with respect to the nut. The tabs may be somewhat concave downwardly as shown in FIG. 6.

FIG. 3 illustrates the ability of the nut/rose to accommodate two different thicknesses of the door. The upper half of FIG. 3 depicts the installation of the lockset on the thinner door so that the tab 48 will actually engage the last riser 92' (FIG. 6) of the steps 88. The lower half of the drawing shows the tab engaging into the nut a short way as with a thick door wherein the tab 48 engages only the first riser 92.

With a spanner wrench after the tabs engage their proximate risers, the rose 38 can be jacked around so that two roses 30 and 38 tightly engage the opposite surfaces of the door.

It should be noted that a stepped structure such as on nut 74 as well as the tabbed rose liner can be also used in the mounting of the outside handle rose assembly. However, the trade is comfortable with the simple threaded sleeve-rose arrangement disclosed on the outside trim and is used to threading the rose 30 farther onto sleeve 16 for thin doors, less far for thick doors.

Thus, it is envisioned that many changes of arrangements, modifications and variations will be apparent to those skilled in the art. The invention, thus, is not limited to the embodiment shown but may be defined in the terms of the following claim language or reasonable equivalents thereof.

What is claimed is:

1. A lockset adapted to be quickly mounted on doors of different thicknesses comprising:

a. a latchbolt retractor housing, b. a latchbolt retractor within said housing, c. an inside sleeve exteriorly threaded and extending longitudinally outward from the housing, d. a nut having interior threads being threaded onto the inside sleeve and having respective ends proximate and remote from the housing, the nut having an outer peripheral surface formed with peripherally spaced cutouts, each cutout comprising an inward opening at the remote end and a pair of steps facing and progressively closer to the proximate end of the nut, the steps from each opening leading in the same peripheral direction of the nut, each of the steps comprising a tread generally formed radial of the nut and a riser following each tread and disposed generally longitudinal of the nut, e. a handle spindle operatively connected to the latchbolt retractor and disposed centrally of the sleeve and extending longitudinally outward thereinside, f. an inside handle assembly comprising:

1. an inside handle having a shank keyed for rotation with the spindle and moveable therealong,
2. an annular rose scalp extending outward from the shank,
3. an annular rose liner being secured within the rose and rotatably secured to the handle and having radially inward tabs spaced about its periphery structured to align with the peripheral openings in the remote end of the nut whereby in installing the lockset on the door, the inside handle assembly may be telescoped over the spindle so that the tabs are received into the openings in the periphery of the nut and the rose may be turned bringing the tabs into engagement with the risers closest to the proximate end of the nut that the width of the door will permit and further turning tightens the nut on the inside sleeve so that the tabs are engaged by the treads preceding the engaged risers to pull the rose scalp and liner snugly against the door.

2. A lockset as claimed in claim 1 wherein each tread has a hump therein toward the proximate end of the nut.

3. A lockset as claimed in claim 1 wherein the rose liner is secured to the rose liner between spaced, opposed annular shoulder means on the shank.

4. A lockset as claimed in claim 1 wherein the nut is U-shaped in radial cross-section so that the nut comprises inner and outer annular walls with an intermediate bight wall and the bight wall is at the remote end of the nut.

5. A lockset as claimed in claim 4 wherein the openings at the remote end of the nut are formed in the outer annular wall and the bight wall and the steps are in the outer annular wall.

6. A lockset as claimed in claim 1 wherein the rose liner is a single annular stamping having the tabs struck inward therefrom.

7. A lockset adapted to be quickly mounted on doors of different thicknesses comprising:

a. a latchbolt retractor housing, b. a latchbolt retractor within said housing, c. an inside sleeve exteriorly threaded and extending longitudinally outward from the housing, d. a nut having interior threads being threaded onto the inside sleeve, e. a handle spindle operatively connected to the latchbolt retractor and disposed centrally of the sleeve and extending longitudinally outward, f. an inside handle assembly comprising:

1. an inside handle keyed for rotation with the spindle and moveable therealong,
2. an annular rose being rotatably secured to the handle with respect thereto, g. connecting means on the rose and the nut to effect mutual engagement at spaced selected positions axial of the nut and rose so that the rose and nut turn together in a rotary direction in which the nut tightens on the sleeve, the connecting means not permitting axial outward movement of rose with respect to the nut when the rose and nut are at one of the positions.

8. A lockset as claimed in claim 7 wherein the nut has steps formed on its periphery, the steps facing the end of the nut proximate the housing and progressively closer to the proximate end in the same direction of pitch as the threads on the inside periphery of the nut, and the rose has a fixed inward tab adapted as the rose is turned to engage the step closest to the proximate end of the nut that the thickness of the door will permit.

9. A lockset as claimed in claim 8 wherein the nut is U-shaped in radial cross-section so that the nut comprises inner and outer annular walls with an intermediate bight wall and the bight wall is at the remote end of the nut.

* * * * *